US005529869A

United States Patent [19]

Nguyen

[11] Patent Number: 5,529,869

[45] Date of Patent: Jun. 25, 1996

[54] REUSABLE POSITIVE-CHARGING ORGANIC PHOTOCONDUCTOR CONTAINING PHTHALOCYANINE PIGMENT AND CROSS-LINKING BINDER

[75] Inventor: Khe C. Nguyen, Milpitas, Calif.

[73] Assignee: Hewlett-Packard Company, Palo Alto, Calif.

[21] Appl. No.: 301,525

[22] Filed: Sep. 7, 1994

Related U.S. Application Data

[63] Continuation of Ser. No. 14,933, Feb. 8, 1993, abandoned.

[51] Int. Cl.[6] ..... G03G 5/04

[52] U.S. Cl. ..... 430/78; 430/96

[58] Field of Search ..... 430/78, 96

[56] References Cited

U.S. PATENT DOCUMENTS 3,954,467 5/1976 Takimoto et al. ..... 430/97

5,183,721 2/1993 Kato et al. ..... 430/96

FOREIGN PATENT DOCUMENTS 0410324 1/1991 European Pat. Off. ..... G03G 5/05

*Primary Examiner*—Mark Chapman

[57] ABSTRACT

An organic positive-charging photoconductor (+) OPC is disclosed. The (+) OPC has a conductive substrate; a hydroxy-containing binder component forming a layer greater than or equal to about 1 micron thick on said substrate; an X-type, metal-free phthalocyanine pigment component uniformly distributed throughout said binder component; and a reactive additive component selected from the list of cross-linkable resins, carboxlyic acid anhydrides, aldehydes, poly-ols, alkoxy silane coupling agents, reactive allyl polymers and dismaleimides, the reactive additive component also being uniformly distributed throughout, and being in cross-linked relation with, the hydroxy-containing binder component with an electron withdrawing functional group and an electron donating functional group in the same molecule. The (+) OPC, which may also contain a co-additive component, exhibits increased stability in a laser printing process.

14 Claims, 3 Drawing Sheets

(AFTER 1000 CYCLES)

(FIRST CYCLE)

REUSABLE POSITIVE-CHARGING ORGANIC PHOTOCONDUCTOR CONTAINING PHTHALOCYANINE PIGMENT AND CROSS-LINKING BINDER

This is a continuation of application Ser. No. 08/014,933 filed 02/08/93, now abandoned.

BACKGROUND OF THE INVENTION

1. Field of the Invention

This invention relates generally to photoconductors for electrophotography. The invention is a positive charging, organic photoconductor material with superior stability for dry and liquid toner electrophotography.

2. Related Art

In electrophotography, a latent image is created on the surface of an insulating, photoconducting material by selectively exposing areas of the surface to light. A difference in electrostatic charge density is created between the areas on the surface exposed and unexposed to light. The visible image is developed by electrostatic toners containing pigment components and thermoplastic components. The toners are selectively attracted to the photoconductor surface either exposed or unexposed to light, depending on the relative electrostatic charges of the photoconductor surface, development electrode and the toner. The photoconductor may be either positively or negatively charged, and the toner system similarly may contain negatively or positively charged particles. For laser printers, the preferred embodiment is that the photoconductor and toner have the same polarity, but different levels of charge.

A sheet of paper or intermediate transfer medium is then given an electrostatic charge opposite that of the toner and passed close to the photoconductor surface, pulling the toner from the photoconductor surface onto the paper or intermediate medium, still in the pattern of the image developed from the photoconductor surface. A set of fuser rollers melts and fixes the toner in the paper, subsequent to direct transfer, or indirect transfer when using an intermediate transfer medium, producing the printed image.

The important photoconductor surface, therefore, has been the subject of much research and development in the electrophotography art. A large number of photoconductor materials have been disclosed as being suitable for the electrophotographic photoconductor surface. For example, inorganic compounds such as amorphous silicon (Si), arsenic selenite ($As_2Se_3$), cadmium sulfide (CdS), selenium (Se), titanium oxide ($TiO_2$) and zinc oxide (ZnO) function as photoconductors. However, these inorganic materials do not satisfy modern requirements in the electrophotography art of low production costs, high-speed response to laser diode or other light-emitting-diode (LED) and safety from non-toxicity.

Therefore, recent progress in the electrophotography art with the photoconductor surface has been made with organic materials as organic photoconductors (OPC). Typically, the OPC's in the current market are of the negative-charging type with a thin charge generation material layer beneath a thicker charge transport material layer deposited on top of the charge generation layer. The negative-charging OPC's perform well for xerographic copiers and printers in the following applications:

a. Low end (4–10 copies per minute) and high end (more than 50 copies per minute) xerographic systems using dry powder developers of one or two colors, or using liquid developers for black and white copies only; and, b. High image quality (above 1800 DPI) color proofing, lithographic plate printing and master xerographic printing systems with life expectancies of less than 100 cycles.

However, prior art negative-charging OPC's also have several drawbacks, namely:

1. Large amounts of ozone are generated in the negative corona charging process, creating environmental concerns. This problem has been addressed by installing ozone absorbers like activated carbon filters, and by using contact negative charging instead of corona charging. These ozone remediation approaches, however, have drawbacks of their own and are not attractive commercial solutions.

2. Negative corona charging generally results in less charge pattern uniformity compared to positive corona charging. Lower charge pattern uniformity in turn results in more noise and less definition in the final image.

3. In small particle toner processes, including fine dry powder and liquid toner processes, designers have been able to develop more charge stability in positively charged toners than in negatively charged toners. Therefore, positive charging OPC's ((+) OPC's) are preferred for a discharged area developed image as in laser printers.

Specific morphologies of phthalocyanine pigment powder have been known to exhibit excellent photoconductivity. These phthalocyanine pigments have been used as a mixture in polymeric binder matrices in electrophotographic photoconductors, deposited on a conductive substrate. In these phthalocyanine/binder photoconductors, the photo-generation of charge and the charge transport occur in the particles of the phthalocyanine pigment while the binder is inert. Therefore, the photoconductor may be made of a single layer of phthalocyanine/binder. These single-layer photoconductors are known to be very good positive charging OPC's due to the hole (positive charge) transportability of the phthalocyanine pigment.

In these single-layer photoconductors, then, there is no need to add charge transport molecules, nor to have a separate charge transport layer. The phthalocyanine pigment content may be in the range of about 10–30 wt. %, high enough to perform both charge generation and charge transport functions, with the binder content being in the range of about 90–70 wt. %. The single photoconductor layer is usually more than about 3 microns (um) thick in order to achieve the required charge acceptance and resulting image contrast. In any event, the single layer is thicker than the charge generation layer of the multi-layer photoconductors.

Also, it is known to use phthalocyanine pigment as a charge generation component in a multi-layer photoconductor. Today, the commercially available OPC for digital electrophotography, wherein the writing head is LED array or laser diode, uses such a multi-layer photoconductor. The charge generation layer containing the phthalocyanine pigment is usually less than 1 micron (um) thick. A charge transport layer about 20–30 microns (um) thick and containing transport molecules other than the phthalocyanine pigment, is over-coated on top of the charge generation layer.

These types of multi-layer OPC's, however, are only used as negative charging ones, so they have all the drawbacks of negative charging OPC's discussed above. So, there remains a strong incentive for the development of a phthalocyanine pigment positive charging OPC.

One response by the industry to this incentive has been to investigate a positive-charging, multi-layer OPC with an electron transport molecule in the upper layer which must be an electron acceptor molecule and an electron transporter molecule under the application of a positive electric field. See, for example, the disclosure of U.S. Pat. No. 4,559,287 (McAneney, et al.). These types of OPC's use derivatives of fluorenylidene methane, for example, as the electron acceptor and transport molecule. These types of molecules, however, exhibit poor solubility, resulting in recrystallization in the OPC forming mixture during coating, poor compatibility with popular binders, and poor reaction yield resulting in high production costs. Also, these types of molecules tend to be highly carcinogenic, resulting in safety risks to workers and users and therefore, low market receptivity.

Also, U.S. Pat. No. 5,087,540 (Murakami et al.) discloses a positive charging, single-layer photoconductor for electrophotography which has X-type and/or T-type phthalocyanine compound dispersed partly in a molecular state and partly in a particulate state in a binder resin. To make the dispersion, the phthalocyanine compound is agitated in a solvent with the binder resin for from several hours to several days. This approach, therefore, has manufacturing drawbacks.

Another response by the industry to the incentive for the development of a phthalocyanine type positive charging OPC has been to investigate a multi-layer OPC wherein the relative positions of the charge generation and transport layers are reversed. See, for example, the disclosure of U.S. Pat. No. 4,891,288 (Fujimaki et al.). These types of OPC's, however, require a protective overcoat to avoid mechanical damage to the OPC because the upper pigment-containing layer is very vulnerable to the development component, the transfer medium component and the cleaning component in the electrophotographic system. These overcoat layers have problems of their own, increasing the residual voltage of the photoconductor and increasing its electrical instability. See, for example, the disclosures of U.S. Pat. No. 4,923,775 (Schank) and U.S. Pat. No. 5,069,993 (Robinette, et al.).

Therefore, it is a first object of this invention to provide a phthalocyanine type positive-charging OPC which exhibits stable electrical properties, including charge acceptance, dark decay and photodischarge, in a high cycle, high severity electrophotographic process. Modern digital imaging systems wherein the writing head is LED array or laser diode, have very high light intensities (about 100 ergs/cm$^2$) over very short exposure time spans (less than 50 nano-seconds), resulting in severe conditions for the OPC compared to optical input copiers with light intensities between about 10–30 ergs/cm$^2$ and exposure times between about several hundred micro-seconds to milliseconds.

Unfortunately, there is no product on the market today which provides such stable electrical properties. This is because the phthalocyanine type positive-charging OPC exhibits instability when it is frequently exposed to the corona charger and the intense light source in the electrophotographic process. I have discovered this instability to be more pronounced at the strong absorption, high light intensity, short exposure time conditions required for the laser printing process. The instability is exhibited in the significant increase of the dark decay after a small number of repeat cycles of laser printing. Also, the instability is exhibited in the decrease in surface potential. These instabilities cause deleterious changes in image contrast, and raise the issue of the reliability of image quality.

Also, I have discovered that these instabilities in the phthalocyanine/binder photoconductor seem to be dependent on the nature of the contact between individual pigment particles. These observations of mine have been made only recently, and there is no report or suggestion in the prior art about how to effectively address and solve the problem of photoconductor instability in the high cycle, high severity electrophotographic process.

Preferably, desirable electrophotographic performance may be defined as high charge acceptance of about 30–100 V/um$^2$, low dark decay of less than about 5 V/sec., and photodischarge of at least 70% of surface charge with the laser diode beam of 780 nm or 830 nm frequency, through the optical system including beam scanner and focus lenses, synchronized at 0.05 micro seconds for each beam.

When conventional binders for the phthalocyanine pigment, such as acrylic resins, phenoxy resins, vinyl polymers including polyvinylacetate and polyvinyl butyryl, polystyrene, polyesters, polyamides, polyimides, polycarbonates, methyl methacrylate, polyurethanes, polyureas, melamine resins, polysulfones, polyarylates, diallyl phthalate resins, polyethylenes and halogenated polymers, including polyvinyl chloride, polyfluorocarbon, etc., are used, acceptable charge acceptance and photodischarge are obtained, provided a good dispersion of the pigment in the binder is obtained. However, among these polymers which result in good performance for charge acceptance and photodischarge, none of them exhibit the desirable stability under the LED array or laser diode exposure conditions. Also, any binders, and accompanying solvents, which do not form a stable dispersion with the phthalocyanine pigment usually exhibit very slow charge acceptance, high residual voltage, or high dark decay, and are therefore unacceptable.

A second object of this invention is to provide a positive-charging OPC with superior durability from mechanical strength, solvent resistance and thermal stability. The (+) OPC must be mechanically strong in order to ensure wear resistance in high cycle applications. It must be solvent resistant in order to prevent it from being changed or lost in the liquid toner applications. It must be thermally stable in order to ensure predictable and repeatable performance at and after different operating temperatures.

The conventional OPC's are presently made with thermoplastic binders which exhibit poor wear resistance, especially in high speed, high-cycle applications using two-component developers, including magnetic carrier and toner, and in applications using tough cleaning blade materials such as polyurethane. Generally, an OPC with a mechanically worn surface exhibits diminished electrophotographic properties, such as low charge acceptance, high dark decay rate, low speed and low contrast.

Also, the conventional thermoplastic binders exhibit high solubility in the solvents used in liquid toner applications. For example, in the wet environment required to achieve very high resolution above 1200 DPI associated with high end applications, the liquid carrier tends to partially dissolve the OPC's binder, causing diminished resolution. Also, in aqueous inking applications, water has an adverse effect on the conductivity of OPC's made with these conventional binders, which effect is aggravated by higher temperatures.

Also, the conventional thermoplastic binders exhibit high thermal degradation in the electrical properties important for electrophotography, reflected in decreased charge acceptance, increased dark decay rate and reduced contrast potential.

In order to satisfy these mechanical, chemical and thermal durability requirements for the OPC, then, a unique cross-linkable polymeric binder material must be obtained.

Generally, cross-linking polymers such as epoxy, phenolic resin, polyurethane, etc., has been known. For reinforced fiber plastics in the electronics packaging industry, for example, significant improvement in the glass transition temperature has been obtained by cross-linking with heat, radiation, (UV, E-beam, X-ray, etc.) and/or moisture. However, for OPC applications general cross-linking principals cannot be freely practiced because photoconductor components such as charge generation molecules (dye, pigment, etc.) and charge transport molecules are vulnerable to the heat, high-energy radiation and moisture used in the cross-linking processes. Therefore, after cross-linking, these molecules may not exist in the cross-linked product in forms in which they are functional as charge generation or charge transport molecules. This is why prior attempts at cross-linking photoconductor binders have not been successful, whether for hole transport molecules such as hydrozones, arylamines, pyrazolines or triphenylmethanes, or for electron transport molecules, such as diphenyl sulfones, fluorenones, quinones, or whether the photoconductor is in a single or a multiple layer. All these attempts exhibit poor compatibility of the transport molecules in the cross-linked binders, resulting in undesirable photodischarge characteristics.

For infrared sensitive photoconductor applications, many phthalocyanine pigments are the center of interest. So far, only alpha-copper phthalocyanine (CuPc) has been reported to be successfully used in a cross-linked binder system without charge transport molecule aid. However, copper phthalocyanine is known to be adequate only for exposure wavelengths shorter than 750 nm, and not appropriate for laser diodes exhibiting the active wavelength at 780 nm or 830 nm.

Many phthalocyanine pigments which exhibit the infrared absorption are usually meta-stable. These crystal forms or morphologies tend to shift toward the more stable crystal forms along with a blue shift in the absorption spectrum when the materials are exposed to the strong solvents, or high energy, especially the temperature required in the cross-linking processes for the binder.

This invention aims at a preparation method for such kinds of infrared-sensitive, phthalocyanine pigments using cross-linkable binder for long-life photoconductor applications.

SUMMARY OF THE INVENTION

I have invented a stable, safe phthalocyanine/binder positive-charging OPC for LED array or laser diode digital electrophotographic systems. I have discovered that, for X-type, metal-free phthalocyanine pigments, specific types of binder resins containing hydroxy group (—OH) and reactive additives which chemically bond to the hydroxy group in the binder result in an electrically stable OPC. The hydroxy group containing-binder is selected from water insoluble plastics such as polyvinyl acetal, polyvinyl formal, phenolic resins, phenoxy resins, cellulose and its derivatives, copolymers of vinyl alcohol, hydroxylated polymers and copolymers of hydroxy monomers and silicon resins. The reactive additive is one:

which can react with the hydroxy group in the binder; and which can maintain the stability of the dispersion of the phthalocyanine pigment.

The combination of the hydroxy group-containing binder and the reactive additive increases the electrical stability of the X-type, metal-free phthalocyanine (Pc) pigment when it is dispersed in the binder as a single-layer photoreceptor. Instability in this system is likely due to electrical contact between individual phthalocyanine pigment particles, regardless of their specific chemical structure or morphology. I have observed this instability with numerous phthalocyanine pigments, including metal-free phthalocyanine, titanyl phthalocyanine, vanadyl phthalocyanine, copper phthalocyanine, zinc phthalocyanine, magnesium phthalocyanine, bromo-indium phthalocyanine, chloro-indium phthalocyanine, etc. The instability increases with decreasing pigment particle size. Also, the instability increases with increased pigment loading. I discovered that using a hydroxy-containing binder reacted with an additive stabilizes the surface charge for a photoconductor containing X-type, metal-free phthalocyanine pigment with particles in the submicron range and exhibiting metastable crystal form by having absorption maxima in the infrared or near infrared range.

The hydroxy group-containing binder and the reactive additive must be carefully selected so that they are compatible and maintain the dispersion stability of the phthalocyanine pigment during their formulation and substrate coating process.

Generally speaking, the reactivity of the hydroxy-containing binder polymers and the cross-linker is expected to occur best in the presence of an acidic or basic catalyst. However, the residue of these catalysts after the cross-linking reaction does great damage to the xerographic performance of the OPC device, reflected as unstable charge acceptance, increased dark decay, etc.

In order to make the cross-linking reaction happen without using acidic or basic catalyst, it is necessary to expose the device to high temperature (for instance, from 100° C.–300° C.) for several hours (for example, 2–3 hours, or more). The high temperature treatment, however, results in a significant reduction of charge acceptance, compared to the specimen treated at a temperature lower than 100° C.

I discovered that the addition of the reactive additives into the hydroxy binder/phthalocyanine dispersion system results in a significant improvement of the charge acceptance of the photoconductor, even after treatment at high temperature, as mentioned above. Moreover, the reduction of the hydroxy content consumed in the cross-linking reaction seems to be the key of the stabilization of the electrical properties of the devices.

The cross-linking effect in the hydroxy binder cross-linker systems can be detected by testing the solubility of the cross-linked materials.

DESCRIPTION OF THE PREFERRED EMBODIMENTS

Figure 1:
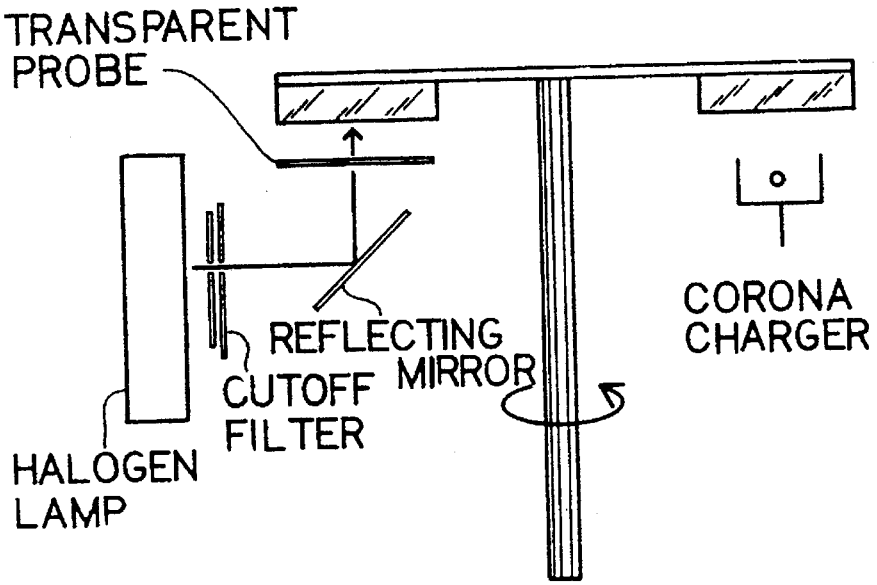
FIG. 1 is a schematic representation of an OPC screening test stand used in my worked Examples.

Preferably, the phthalocyanine pigment component has the general formula:

$HPcX_n$ (A)

Where X=halogen (Cl, Br, I, F), nitro (—$NO_2$), cyano (—CN), sulfonyl (—$RSO_2NH_2$, alkyl, alkoxy, etc., and n=0–4.

The phthalocyanine pigment component may be a single pigment selected from this group, or a combination of two or more pigments from this group.

The X-type, metal free phthalocyanine pigment may be used alone or mixed with one or more of the well dispersed phthalocyanine pigments including titanyl phthalocyanines, vanadyl phthalocyanines, aluminum phthalocyanines, haloindium phthalocyanines, magnesium phthalocyanines, zinc phthalocyanines, yttrium phthalocyanines, and copper phthalocyanines.

Preferably, the phthalocyanine pigment component is present in the range of about 8 wt. % to about 50 wt. %, relative to the hydroxy-containing binder component.

The hydroxy-containing binder may be:

1) Polyvinyl acetals with general structure (I):

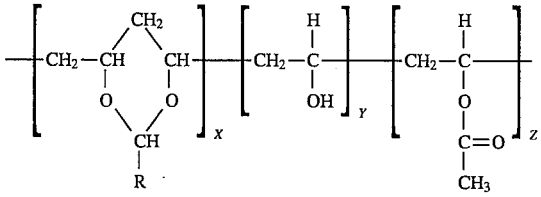

(I)

Where R=alkyl, alkoxy, amino groups, amino-alkyl, cyano —CN, halogen (Cl, Br, I, F), nitro —$NO_2$, hydroxy —OH, aryl and arylalkyl with substituent groups —$NO_2$, —CN, —OH, halogens, amino, heterocyclic groups, etc.

The hydroxy content Y of the polyvinyl acetals may be in the range between 1% and 50%. Two preferred polyvinyl acetals are:

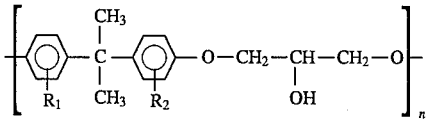

(III)

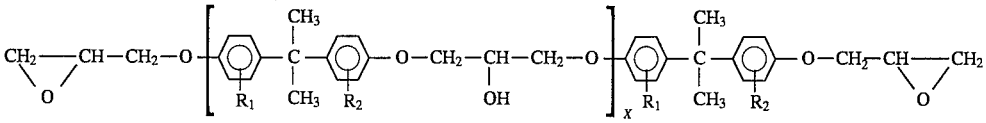

(IV)

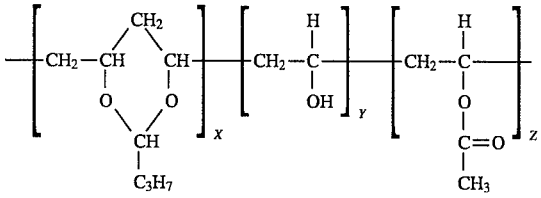

(I-a)

-continued

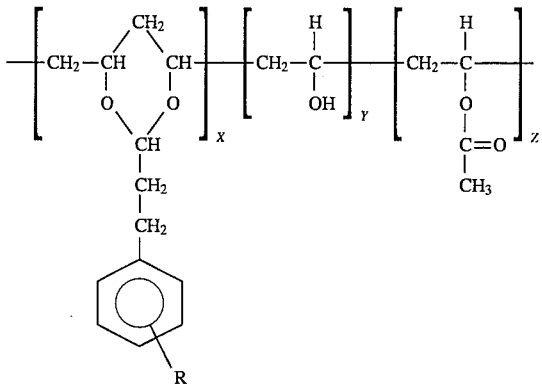

(I-b)

2) Phenolic Resins with general structure (II):

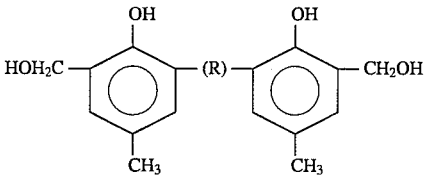

(II)

Where R=alkyl, alkoxy, amino groups, amino-alkyl, cyano —CN, halogen (Cl, Br, I, F), nitro —$NO_2$, hydroxy —OH, aryl and arylalkyl with substituent groups —$NO_2$, —CN, —OH, halogens, amino, heterocyclic groups, etc.

3) Phenoxy resins with general structure (III) or (IV):

Where $R_1$, $R_2$=alkyl, alkoxy, aminoalkyl, halogen (Cl, Br, I, F), nitro —$NO_2$, cyano-CN, and -hydroxy, etc., and 4) Cellulose and its derivatives, including:

cellulose acetate nitro cellulose, and butyl cellulose

5) Copolymers of vinyl alcohol with general structure (V) or (VI):

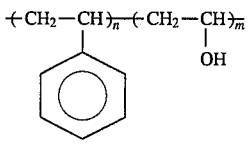

(V)

-continued

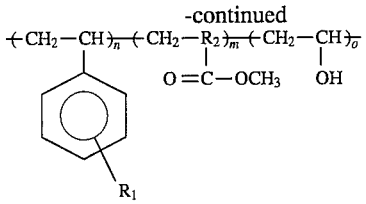

(VI)

Where $R_1$=aryl, alkyl, alkoxy, aminoalkyl, amino, nitro, hydroxy, cyano, halogen, etc.

and $R_2$=aryl, alkyl, alkoxy, amino, aminoalkyl, nitro, hydroxy, cyano, halogen, etc.

6) Hydroxylated polymers, polystyrenes, polyesters, and polycarbonates, and

7) Copolymers of hydroxy monomers and silicon resins.

The reactive additive may be:

a) Cross-linkable resins such as

Epoxy:

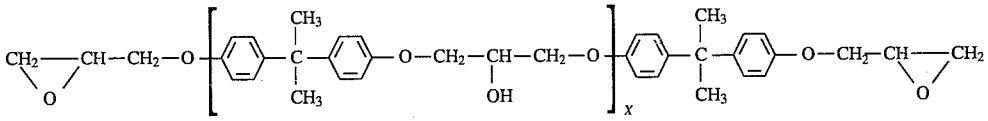

(VII)

X=10–100,000

Poly diisocyanate:

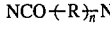

(VIII)

R=aryl, alkyl, alkoxy, aminoalkyl, amino, nitro, hydroxy, cyano, halogen, etc.

n=1–10,000

Melamine resin:

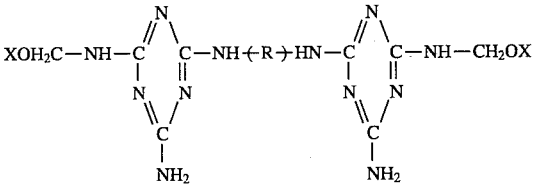

(IX)

X=Hydrogen, Alkyl, Aryl with or without substituent groups, Helerocyclic Ring

R=aryl, alkyl, alkoxy, aminoalkyl, amino, nitro, hydroxy, cyano, halogen, etc.

n=10–100,000

Alkyd resins:

for example, glyptal

Phenolic resins:

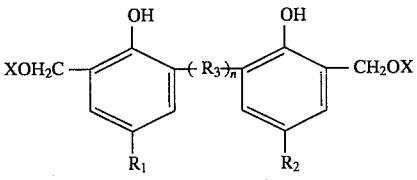

(XI)

X=H, Alkyl, Aryl, etc. $R_1$, $R_2$, $R_3$=aryl, alkyl, alkoxy, aminoalkyl, amino, nitro, hydroxy, cyano, halogen, etc.

n=10–100,000

Polyester resins:

Polyimide resins:

Silanol ended poly siloxanes: for example,

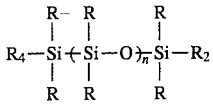

(XII)

R, $R_1$, $R_2$=aryl, alkyl, alkoxy, aminoalkyl, amino, nitro, hydroxy, cyano, halogen, etc.

b) Reactive carboxylic acid anhydrides with the general chemical structure

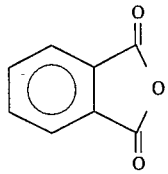

(XIII-a-i)

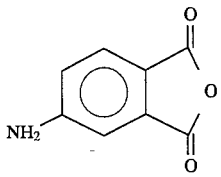

(XIII-a-ii)

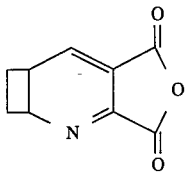

(XIII-a-iii)

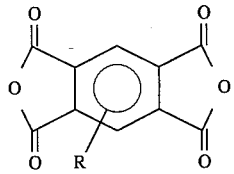

(XIII-b)

R=aryl, alkyl, alkoxy, aminoalkyl, amino, nitro, hydroxy, cyano, halogen, etc.

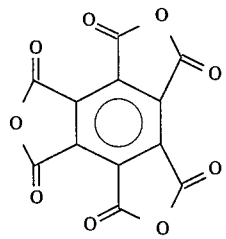

(XIII-c)

c) Reactive aldehydes with the general chemical structure:

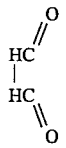

(XIV-a)

R=aryl, alkyl, alkoxy, aminoalkyl, amino, nitro, hydroxy, cyano, halogen, etc.

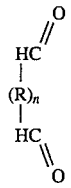

(XIV-b)

d) Reactive poly-ols with the general chemical structure:

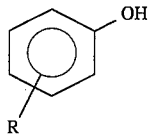

(XV-a)

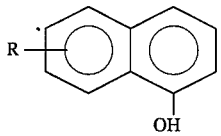

(XV-b)

R=aryl, alkyl, alkoxy, aminoalkyl, amino, nitro, hydroxy, cyano, halogen, etc.

e) Reactive alkoxy silane coupling agents with the general structure:

$$R_1—Si(OR_2)_3 \quad \text{(XVI)}$$

$R_1$, $R_2$=aryl, alkyl, alkoxy, aminoalkyl, amino, nitro, hydroxy, cyano, halogen, etc.

f) Reactive allyl polymers:

for example, from allyl diethylenegylcol-biscarbonate monomer, or from di-isopropylperoxydicarbonate monomer; and, g) dismaleimides.

Preferably, the reactive additive component is present in the range of about 0.0015 wt. % to about 95 wt. %, relative to the hydroxy-containing binder component.

The hydroxy binder and reactive additive can be used together or also in conjunction with a co-additive component but which does not take part in the cross-linking reaction, which is believed to reduce the reactivity of any free remaining hydroxy groups by weaker interactions, such as VanderWall forces, hydrogen bonding, etc. These co-additives may be selected from the group of chemicals which contain both electron withdrawing group and electron donating group in one molecule. Examples of these co-additives are:

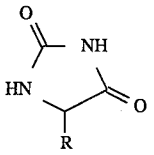

(XVII-a)

-continued

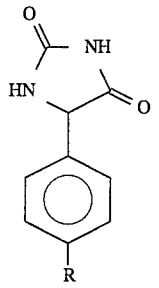

(XVII-b)

R=aryl, alkyl, alkoxy, aminoalkyl, amino, nitro, hydroxy, cyano, halogen, etc.

Also, these co-additives may include, for example, from the Aldrich Chemical Company Catalog Handbook of Fine Chemicals (1992):

TABLE 1

| NAME | PAGE | CAT. NO. |
|---|---|---|
| 1. 4-Pyrimidone | 1078 | 85,806-4 |
| 2. Pyrido-1,4,-oxazin-one | 1075 | 14,524-6 |
| 3. 2,3-Pyridinedicarboxylic anhydride | 1073 | P6,440-5 |
| 4. 2-(N-Propylcarbamoyl)-1,2,3,4 tetrahydroisoquinoline | 1064 | 29,141-2 |
| 5. Aminophthalimide | 79 | 17,834-4 |
| 6. 4-Amino-9-fluorenone | 64 | 12,294-7 |
| 7. 6-Amino-3,4-benzocoumarin | 51 | 30,023-3 |
| 8. 7-Amino-4-methylcoumarin | 70 | 25,737-0 |
| 9. Antipyrine | 101 | A9,135-3 |
| 10. 4-Antipyrinecarboxaldehyde | 101 | 12,325-0 |
| 11. Benzalphthalide | 118 | B-180-6 |
| 12. 2-Benzoxazolinone | 127 | 15,705-8 |
| 13. 3-Benzylphthalide | 139 | 15,320-6 |
| 14. 2-(4-Biphenylyl)-5-(4-tert-butylphenyl) -1,3,4oxadiazole | 147 | 22,400-6 |
| 15. 2-(4-Biphenylyl)-5-phenyl-1,3,4 -oxadiazole | 148 | 25,785-0 |
| 16. 3-Cyanoindole | 347 | 34,794-9 |
| 17. 1,4-Dichlorophthalazine | 422 | 12,602-0 |
| 18. 3,4-Dimethyl-1-phenyl-3-pyrazolin-5-one | 514 | 23,120-7 |
| 19. 2,5-Diphenyl-1,3,4-oxadiazole | 536 | D21,021-8 |
| 20. 4-Hydroxyantipyrine | 693 | 10,942-8 |
| 21. 1-(2-Mesitylenesulfonyl)-1,2,4-triazole | 796 | 22,638-6 |
| 22. 3-Methyl-1-phenyl-2-pyrazolin-5-one | 870 | M7,080-0 |
| 23. Tetrahydro-2-pyrimidone | 1166 | T1,520-2 |
| 24. Phthalazine | 1015 | P3,870-6 |
| 25. 1-Methylhydantoin | 850 | M4,988-7 |

Preferably, the co-additive component is present in the range of about 0.0015 wt. % to about 95 wt. %, relative to the hydroxy-containing binder component.

The components of my photoconductor, namely: X-type, metal-free phthalocyanine pigment, hydroxy-containing binder and reactive additive, and, optionally, the co-additive, need to be mixed separately and then mixed together in order to maximize the beneficial stabilizing effect. For example, the phthalocyanine pigment is first premixed with a solvent and the reactive additive by using ceramic, glass, table salt or metal beads as milling media. The pigment grinding equipment may be selected from the conventional equipment, such as ball mill, sand mill, paint shaker, attritor, homogenizer, Sweeco™ mill, small media mill, etc. These milling procedures are able to provide a good dispersion of the pigment, defined as the average particle size of the pigment being in the submicron range.

The premix dispersion of the pigment with the reactive additive tends to strongly adsorb the additive molecule on the surface of the pigment to make the charging stabilization of the photoconductor more effective.

The premixed phthalocyanine pigment/reactive additive dispersion is then added to the hydroxy binder solution and slightly milled to achieve the final coating solution. The whole mixture, pigment/reactive additive/hydroxy binder, exhibits excellent dispersion stability for from several months to a year.

The coating solution is applied to the conductive substrate in a conventional manner, like by dipping or casting, for example. Then, the applied film must be cured at cross-linking conditions, with higher temperature, for example, at about 100°–300° C. for several hours to initiate and complete the reaction between the binder and the reactive additive. Other, conventional cross-linking techniques may be used, for example, radiation (UV, E-beam, X-ray, etc.) and/or moisture.

The cross-linking reaction between the hydroxy-containing binder and the reactive additive is effective to stop the increased dark decay of the phthalocyanine/binder photoconductor for many cycles, even with severe exposure conditions. However, surface positive charge will decrease after some cycles unless additive molecules are not only in the bulk of the OPC, but also on its surface to provide complete protection. I think this is because positive charges may be injected into the bulk of the OPC through particles of phthalocyanine pigment on the surface of the OPC. For example, I observed that when an OPC is prepared with its outer surface containing 100% additive molecules, and no binder molecules, excellent surface charge stability, even after more than one hundred thousand cycles, is observed.

EXAMPLES

OPC SCREENING TEST

Two OPC samples prepared as above were mounted in the sample holders of an OPC turntable test stand depicted schematically in FIG. 1. The test stand was a Monroe Electronics Co. Charge Analyzer 276A, the set-up and use of which are well-known in the electrophotographic industry. The samples were rotated at 1,000 rpm and exposed at one location in their revolution to a +6000 V corona charger to receive a positive charge. At a subsequent location in their revolution, the samples were exposed to a halogen light source equipped with an interference filter, neutral filter and cut-off filter to provide a narrow wavelength band light of 780 nm. The light illuminated the positively charged OPC samples. The surface potential of the OPC samples were measured and recorded. The potential Vo is measured as the charge acceptance after 35 seconds of being charged, and the potential Ve is measured as the dark decay after being left to discharge for 10 seconds in the dark.

LIFE TEST

Figure 2:
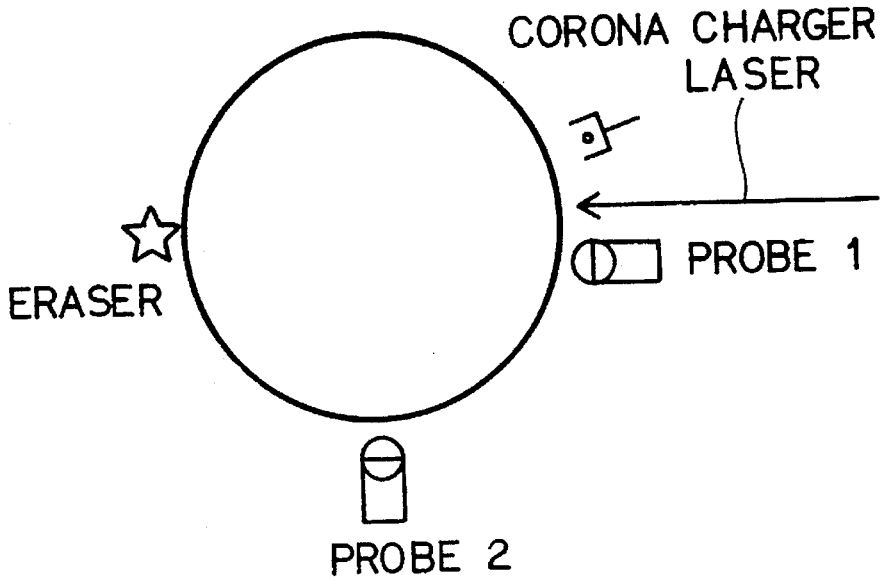
FIG. 2 is a schematic representation of an OPC writing life test stand used in my worked Examples.
Figure 3B:
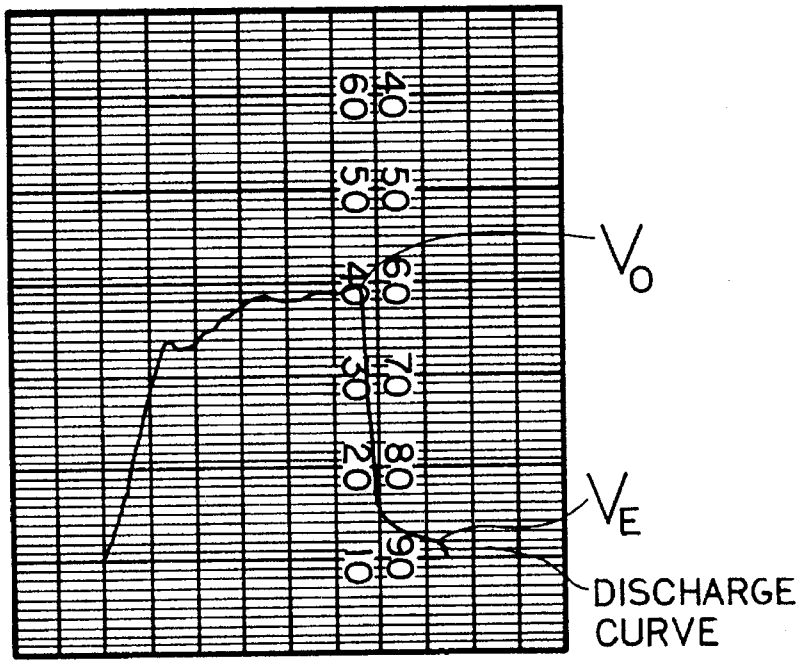
FIGS. 3A and 3B are charging and discharging curves from worked Examples on the OPC screening test stands depicted in FIG. 1.
Figure 3A:
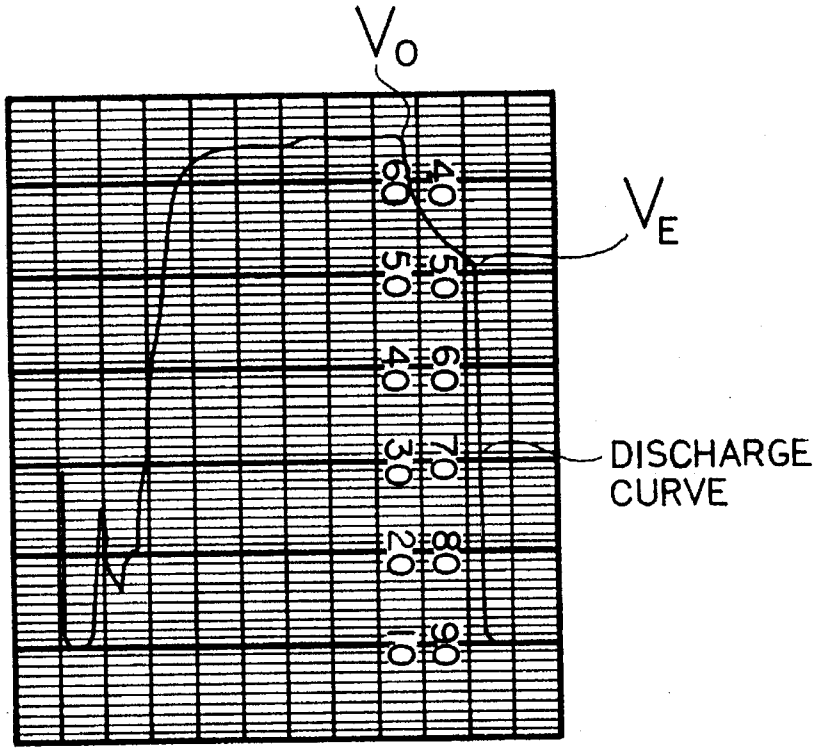
Figure 4A:
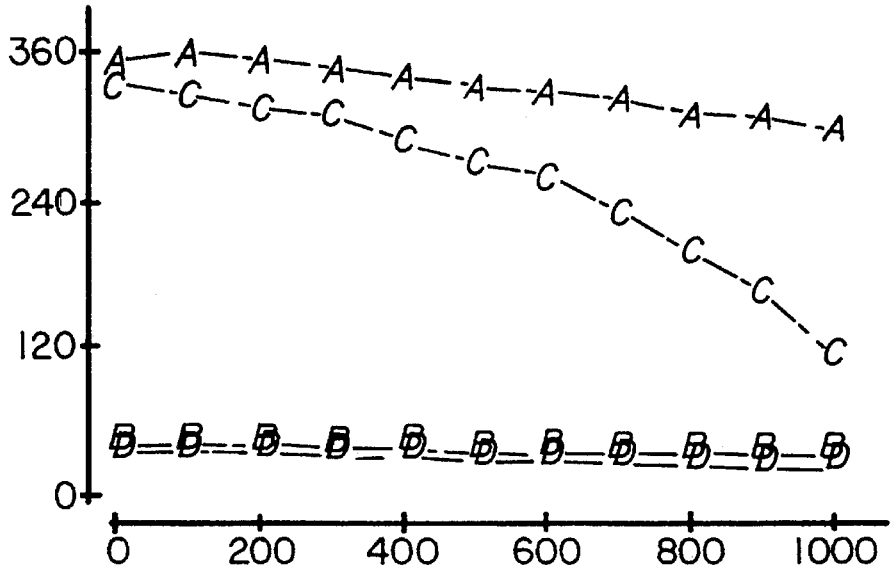
FIGS. 4A and 4B are stability curves from worked Examples on the OPC writing life test stand depicted in FIG. 2.
Figure 4B:
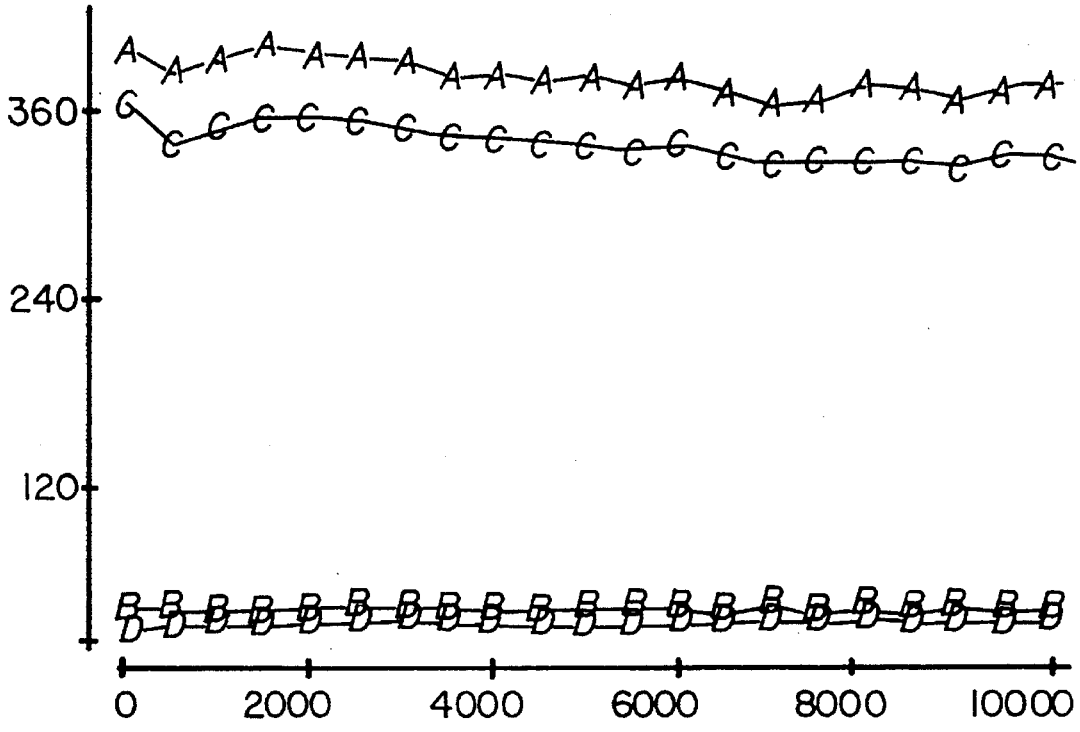

In order to study the electrical stability of the OPC samples prepared as above, they were wrapped around a 135 mm dia. aluminum drum of a laser testbed printer built by Hewlett-Packard Co. and depicted schematically in FIG. 2. The OPC samples on the drum were positively charged at the corona with +400 uA and then rotated clockwise past the laser beam location to the first electrostatic probe 1, a Trek Co. Model #360, to measure the OPC surface potential. Measurements at probe 1, after passing through the laser beam location, were made of 0% laser (laser is off) and 100% laser (laser is on), for $V_1(0)$ and $V_1(100)$, respectively.

A second electrostatic probe 2 located at the developer station permits corresponding surface potential measurements there of $V_2(0)$—laser is off and $V_2(100)$—laser is on. After 1000 cycles on the life test stand, the used samples are removed and measured again on the screening test stand to compare their performance before and after the life test.

LIFE TEST AT ELEVATED TEMPERATURE

In order to study the electrical properties of the OPC samples prepared as above, they were mounted on the surface of a 30 mm diameter Al drum in a drum tester, Cynthia Model 90, made by Gentek Company, Tokyo. A heater is installed inside of the drum, monitored with a thermo-couple, to control the surface temperature of the sample. The drum is rotated (90 rpm) and is exposed to corona charger, 780 nm laser exposer (2.6 mW output), electrometer probe (to detect the surface potential of the sample), LED eraser (660 nm). The electrical stability of the device is detected by measuring the change in the dark decay rate (V/s) after 4 sec of the fresh sample and the used sample.

1) 4 g of x-type metal-free phthalocyanine pigment (X-H2Pc) 21.5 g of polyvinyl butyral (Aldrich Chemical), 150 g of dichloromethane (DCM), and 3 mm diameter steel stainless beads were milled together in a glass container, using a roll mill system for 3 hours. The mixture was coated on aluminum substrate using a wire bar to achieve a photoconductor thickness of 15 um after being dried at 80° C. for 2 hrs. For reference, another piece of the same specimen was dried at different temperatures, 135° C. and 200° C., for 2–3 hours.

2) 4 g of x-type, metal-free phthalocyanine pigment (x-H2Pc) 15 g of polyvinyl butyral (Aldrich Chemical), 6.5 g of poly diisocyanate (Mondur 75, Mobay Chemical), and 150 g of dichloromethane (DCM) were milled together, and a photoconductor prepared, using the same procedure described in Example 1, above.

These OPCs samples were tested with the screening test, life test and elevated temperature life test described above. The results are illustrated in Table 2.

TABLE 2

| Sample | Curing temp. | Vo | DD (55° C.,1) | DD (55° C.,1000) |
|---|---|---|---|---|
| 1 | 80° C. | 600 V | 25 V/s | 150 V/s |
| 1 | 135° C. | 300 V | 75 V/s | 165 V/s |
| 1 | 200° C. | 50 V | 100 V/s | 170 V/s |
| 2 | — | — | — | — |
| 2 | 135° C. | 850 V | 3 V/s | 4.5 V/s |
| 2 | 200° C. | 843 V | 4 V/s | 4.2 V/s |

The amount of cross-linking reaction was studied indirectly. In my tests I first weighed ($M_1$) and then submerged the finished photoconductor in a bath of dichloromethane (DCM). Then, the photoconductor was left to sit in the bath for several hours, after which it was dried at 80° C. for about 1 hour. Then I weighed it again ($M_2$) and determined the difference $M_1$–$M_2$. The expression, $(M_1-M_2)/M_1$ relates to the % cross-linking, presuming the photoconductor lost has been dissolved in the DCM and not protected by cross-linking. The test may be called the dichloromethane (DCM) bath test.

The cross-linking test result is illustrated in Table 3.

TABLE 3

| Sample | Curing temp. | Cross-linking |
|---|---|---|
| 1 | 80° C. | 0% |
| 1 | 135° C. | 0% |
| 1 | 200° C. | <20% |
| 2 | 135° C. | 67% |
| 2 | 200° C. | 85% |

The above results reveal that the addition of a reactive additive such as poly diisocyanate into a polyvinyl butyral binder X-H2Pc system exhibits:

a) Enhanced cross-linking effect;

b) Improved charge acceptance and charge retention ability; and, c) Improved the thermal stability of the device at elevated operating temperature. 4) Repeat Example 2, except that the following additives were used instead of poly diisocyanate Mondur 75.

3) Epoxy, Epon (Shell)

4) Phenolic resin, Santolink (Monsanto)

5) Melamine resin, Cymel 325 (American Cyanamide)

6) Alkyd resin

7) Poly hydrogen methyl siloxane, silanol terminated (Aldrich Chemical)

The results are illustrated in Table 4.

TABLE 4

| Sample | Curing temp. | X-link % | Vo | DD change |
|---|---|---|---|---|
| 3 | 200° C. | 46% | 700 V | +10% |
| 4 | 200° C. | >85% | 780 V | +6% |
| 5 | 200° C. | >85% | 720 V | +6% |
| 6 | 200° C. | >85% | 600 V | +6% |
| 7 | 200° C. | 65% | 580 V | +6% |
| 1 (Ref) | 200° C. | <20% | 50 V | +41% |

It should be noted that DD change (%) is determined as the ratio between DD (55° C., 1) and DD (55° C., 1000).

5) Repeat Example 1, except that the following cross-linkers were added in the amount of 1 g to the above-described formulation.

8) Phthalic anhydride

9) Pyridine dicarboxylic anhydride

10) Amino Phthalic anhydride

11) Resorcinol

12) Nitrophenol

13) Dinitronaphthol

14) Trimethoxy silane

15) Aminopropyltriethoxy silane

The results are illustrated in Table 5.

TABLE 5

| Sample | Curing temp. | X-link % | Vo | DD change |
|---|---|---|---|---|
| 1 (Ref) | 200° C. | <20% | 50 V | 41% |
| 8 | 200° C. | 70% | 450 V | 10% |
| 9 | 200° C. | 65% | 455 V | 10% |
| 10 | 200° C. | 73% | 550 V | 8% |
| 11 | 200° C. | 68% | 600 V | 10% |
| 12 | 200° C. | 68% | 650 V | 10% |
| 13 | 200° C. | 70% | 580 V | 10% |

6) Example 2 above, was repeated except that melamine resin was used instead of poly isocyanate, and 0.2 grams of co-additive 1-methylhydantoin was added to make the photoconductor, which tested as follows:

TABLE 6

| Sample | X-Link % | Vo | DD change |
|---|---|---|---|
| 16 | 78 | 690 V | 1% |

From comparing these results with the test results of the other samples, it may be seen that this is an especially preferred embodiment of my invention.

While there is shown and described the present preferred embodiment of the invention, it is to be distinctly understood that this invention is not limited thereto but may be variously embodied to practice within the scope of the following claims.

I claim:

1. A positive-charging, organic photoconductor for electrophotography, comprising:

a conductive substrate;

a hydroxy-containing binder component forming a layer greater than or equal to about 1 micron thick on said substrate;

an X-type, metal-free phthalocyanine pigment component uniformly distributed throughout said binder component in the range of about 8 wt. % to about 50 wt. %, relative to the hydroxy-containing binder component; and a reactive additive component selected from the group consisting of cross-linkable resins, carboxylic acid anhydrides, aldehydes, poly-ols, alkoxy silane coupling agents, reactive allyl polymers and dismaleimides, said reactive additive component also being uniformly distributed throughout, and being in cross-linked relation with, said hydroxy-containing binder component, wherein the said cross-linked relation of the reactive additive component with the hydroxy-containing binder component results in improved electrical charge acceptance and charge retention ability of the organic photoconductor, and results in the % cross-linking of the organic photoconductor being greater than about 46% as measured by the dichloromethane bath test.

2. The photoconductor of claim 1 wherein the hydroxy-containing binder is selected from the group of polyvinyl acetals, polyvinyl formals, phenolic resins, phenoxy resins, cellulose and its derivatives, copolymers of vinyl alcohol, hydroxylated polymers, and copolymers of hydroxy monomers and silicon resins.

3. The photoconductor of claim 1 wherein the phthalocyanine pigment has a particle size of less than one micron with absorption maxima in the infrared or near infrared range.

4. The photoconductor of claim 1 wherein the phthalocyanine pigment component is a combination of two or more types of X-type metal-free phthalocyanine pigments.

5. The photoconductor of claim 1 which also comprises a metal-type phthalocyanine component.

6. The photoconductor of claim 1 wherein the phthalocyanine pigment component is present in the range of about 8 wt. % to about 50 wt. %, relative to the hydroxy-containing binder component.

7. The photoconductor of claim 1 wherein the reactive additive component is present in the range of about 0.0015 wt. % to about 95 wt. %, relative to the hydroxy-containing binder component.

8. The photoconductor of claim 1 which also comprises a co-additive component selected from the group of chemicals which contain both an electron withdrawing functional group and an electron donating function group in one molecule.

9. The photoconductor of claim 1 which also comprises a co-additive component selected from the group consisting of 4-Pyrimidone, Pyrido-1,4,-oxazin-one, 2,3-Pyridinedicarboxylic anhydride, 2-(N-Propylcarbamoyl)-1,2,3,4 tetrahydroisoquinoline, Aminophthalimide, 4-Amino-9-fluorenone, 6-Amino-3,4-benzocoumarin,
7-Amino-4-methylcoumarin,
Antipyrine
4-Antipyrinecarboxaldehyde,
Benzalphthalide,
2-Benzoxazolinone,
3-Benzylphthalide,
2-(4-Biphenylyl)-5-(4-tert-butylphenyl)-1,3,4oxadiazole,
2-(4- Biphepylyl)-5-phenyl-1,3,4-oxadiazole,
3-Cyanoindole,
1,4-Dichlorophthalazine,
3,4-Dimethyl-1-phenyl-3-pyrazolin-5-one,
2,5-Diphenyl-1,3,4-oxadiazole,
4-Hydroxyantipyrine,
1-(2-Mesitylenesulfonyl)-1,2,4-triazole,
3-Methyl-1-phenyl-2-pyrazolin-5-one,
Tetrahydro-2-pyrimidone,
Phthalazine, and
1-Methylhydantoin.

10. The photoconductor of claim 8 wherein the co-additive component is present in the range of about 0.0015 wt. % to about 95 wt. %, relative to the hydroxy-containing binder component.

11. The photoconductor of claim 9 wherein the co-additive component is present in the range of about 0.0015 wt. % to about 95 wt. %, relative to the hydroxy-containing binder component.

12. The photoconductor of claim 1 wherein the phthalocyanine pigment component is formed from a premixed dispersion with a solvent.

13. A method for making a positive-charging, organic photoconductor for electrophotography which comprises:

pre-mixing an X-type, metal-free phthalocyanine pigment, a reactive additive component selected from the group consisting of cross-linkable resins, carboxylic acid anhydrides, aldehydes, poly-ols, alkoxy silane coupling agents, reactive allyl polymers and dismaleimides, and a solvent to obtain a premix dispersion;

adding the premix dispersion to a solution containing a hydroxy-containing binder component, the X-type metal-free phthalocyanine component being in the range of about 8 wt % to about 50 wt %, relative to the hydroxy-containing binder component, to obtain a coating solution;

applying the coating solution to a conductive substrate; and subjecting the coated substrate to cross-linking conditions to cross-link the said reactive additive component with the said hydroxy-containing binder component, wherein the said cross-linking results in improved electrical charge acceptance and charge retention ability of the organic photoconductor, and results in the % cross-linking of the organic photoconductor being greater than about 46% as measured by the dichloromethane bath test.

14. The method of claim 13 wherein the cross-linking conditions include a cure at temperatures between about 100°–300° C. for 2–3 hours.

* * * * *